US009760043B1

(12) United States Patent
Funayama et al.

(10) Patent No.: US 9,760,043 B1
(45) Date of Patent: Sep. 12, 2017

(54) FIXING DEVICE, COLLECTING ROLLER, AND IMAGE FORMING APPARATUS

(71) Applicant: FUJI XEROX CO., LTD., Tokyo (JP)

(72) Inventors: Yasuhiro Funayama, Kanagawa (JP); Masahiro Katahira, Kanagawa (JP); Yoshinori Takahashi, Kanagawa (JP); Yuki Nagamori, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/219,809

(22) Filed: Jul. 26, 2016

(30) Foreign Application Priority Data

Feb. 26, 2016 (JP) ..... 2016-036192

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2021; G03G 15/2017; G03G 15/2039
USPC ..... 399/327
See application file for complete search history.

(56) References Cited

U.S. PATENT DOCUMENTS 3,929,095 A * 12/1975 Thettu ..... G03G 15/2025 118/104
5,212,528 A * 5/1993 Matsuda ..... G03G 15/2039 165/89
2014/0270866 A1* 9/2014 Hatazaki ..... G03G 15/2025 399/327
2015/0063857 A1* 3/2015 Battat ..... G03G 15/2021 399/94

FOREIGN PATENT DOCUMENTS

JP 2008102346 A * 5/2008
JP 2015-161733 A 9/2015

* cited by examiner

*Primary Examiner* — Billy Lactaoen
(74) *Attorney, Agent, or Firm* — Sughrue Mion, PLLC

(57) ABSTRACT

A fixing device includes a fixing roller that fixes a toner image to a recording medium; a cleaning roller that contacts the fixing roller and rotates, and cleans off toner adhered to a surface of the fixing roller; and a collecting roller that contacts the cleaning roller and rotates, and collects toner adhered to a surface of the cleaning roller, the collecting roller including an air passage section that extends through the collecting roller in an axial direction of the collecting roller and through which air passes.

10 Claims, 11 Drawing Sheets

FIXING DEVICE, COLLECTING ROLLER, AND IMAGE FORMING APPARATUS

CROSS-REFERENCE TO RELATED APPLICATIONS

This application is based on and claims priority under 35 USC 119 from Japanese Patent Application No. 2016-036192 filed Feb. 26, 2016.

BACKGROUND

Technical Field

The present invention relates to a fixing device, a collecting roller, and an image forming apparatus.

SUMMARY

According to an aspect of the invention, there is provided a fixing device including a fixing roller that fixes a toner image to a recording medium; a cleaning roller that contacts the fixing roller and rotates, and cleans off toner adhered to a surface of the fixing roller; and a collecting roller that contacts the cleaning roller and rotates, and collects toner adhered to a surface of the cleaning roller, the collecting roller including an air passage section that extends through the collecting roller in an axial direction of the collecting roller and through which air passes.

BRIEF DESCRIPTION OF THE DRAWINGS

Exemplary embodiments of the present invention will be described in detail based on the following figures, wherein.

DETAILED DESCRIPTION

An image forming apparatus according to an exemplary embodiment of the present invention is described below on the basis of the drawings.

First Exemplary Embodiment

Overall Structure of Image Forming Apparatus

Figure 1:
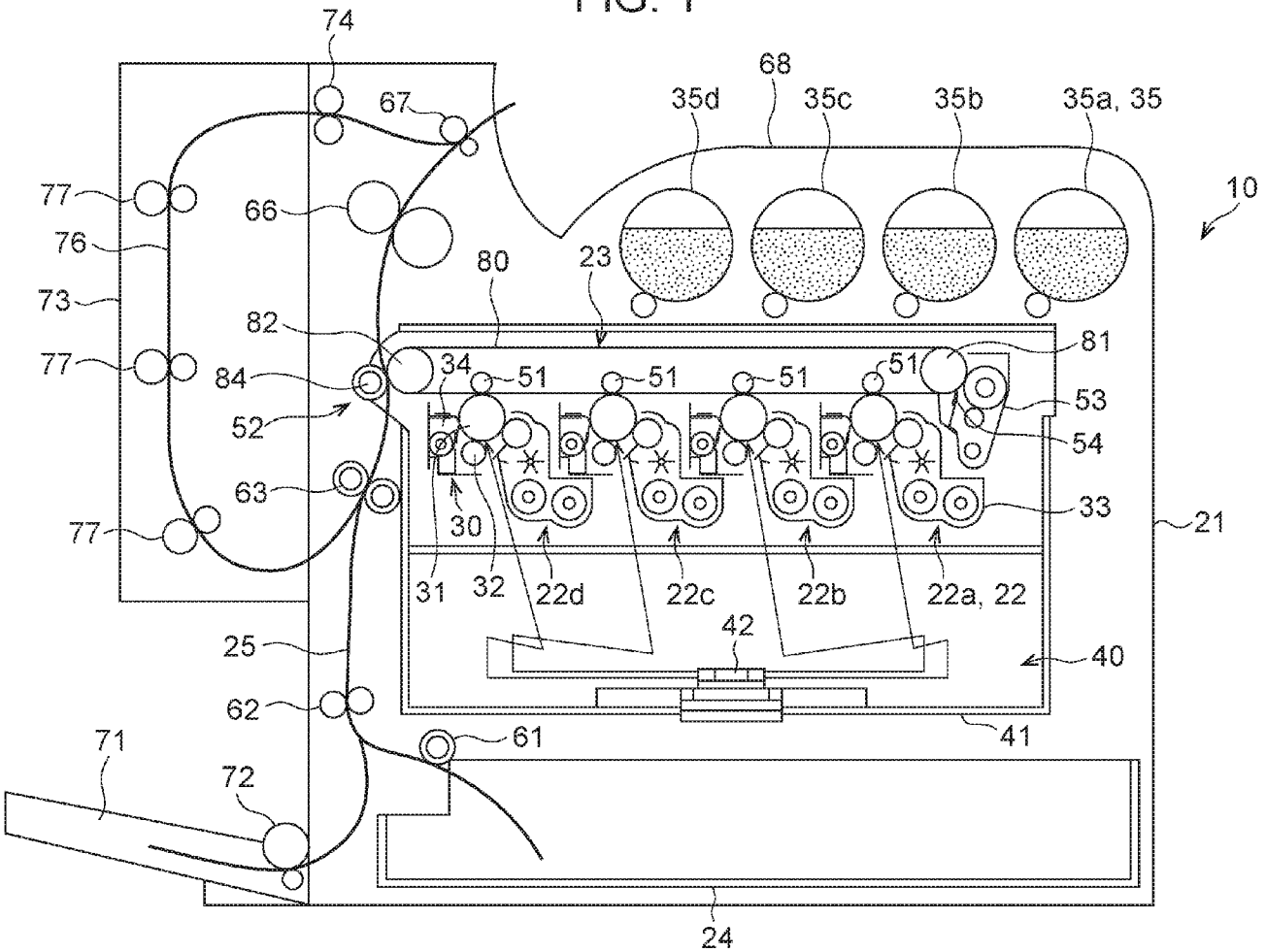
FIG. 1 illustrates a structure of an image forming apparatus according to an exemplary embodiment of the present invention.

FIG. 1 illustrates a structure of an image forming apparatus according to the exemplary embodiment, the image forming apparatus being described as the so-called tandem image forming apparatus 10.

As shown in FIG. 1, the image forming apparatus 10 includes image forming units 22 (more specifically, image forming units 22*a*, 22*b*, 22*c*, and 22*d*) and a belt module 23 in a body housing 21. The image forming units 22 are provided for four colors, that is, yellow, magenta, cyan, and black. The belt module 23 is disposed above the image forming units 22 along a direction of arrangement of the image forming units 22. The image forming apparatus 10 further includes a cassette 24 at a lower portion side of the body housing 21. The cassette 24 accommodates recording media (not shown), such as sheets. The image forming apparatus 10 still further includes a transport path 25 serving as an exemplary transport section through which a recording medium is transported upward from the cassette 24.

The image forming units 22 form, for example, a corresponding yellow toner image, a corresponding magenta toner image, a corresponding cyan toner image, and a corresponding black toner image in that order from an upstream side in a circulation direction of an intermediate transfer belt 80. (The toner images are not necessarily formed in the aforementioned order.) Each image forming unit 22 includes a photoconductor unit 30 and a developing unit 33. The image forming units 22 are provided with one common exposure unit 40. Each photoconductor unit 30 includes a photoconductor drum 31, a charging roller 32 that charges the photoconductor drum 31, and a cleaning device 34 that removes residual toner on the photoconductor drum 31. The exposure unit 40 houses, for example, four semiconductor lasers (not shown), one polygon mirror 42, an imaging lens (not shown), and mirrors (not shown) corresponding to the photoconductor units 30 in a unit case 41. Each developing unit 33 develops an electrostatic latent image with toner of a corresponding color (having, for example, a negative polarity), each electrostatic latent image being formed on the corresponding photoconductor drum 31 by exposure by the exposure unit 40. Toner cartridges 35 (more specifically, toner cartridges 35*a*, 35*b*, 35*c*, and 35*d*) for replenishing the respective developing units 33 with toner of respective color components are provided at an upper portion side of the body housing 21.

The belt module 23 includes the intermediate transfer belt 80 placed around a pair of support rollers 81 and 82 (one of the support rollers is a driving roller). First transfer rollers 51 are disposed at an inner side of the intermediate transfer belt 80 in correspondence with the photoconductor drums 31 of the respective photoconductor units 30. By applying a voltage having a polarity that is opposite to a toner charging polarity to each first transfer roller 51, the toner images on the respective photoconductor drums 31 are electrostatically transferred to the intermediate transfer belt 80. Further, a transfer device 52 of a transfer section is disposed at a portion in correspondence with the support roller 82 disposed at a downstream side of the image forming unit 22*d* disposed at the lowermost stream side of the intermediate transfer belt 80. The toner images on an outer surface of the intermediate transfer belt 80 are second-transferred (batch-transferred) to a recording medium.

The transfer device 52 includes a second transfer roller 84, and a back roller (the support roller 82 is used as the back roller in the exemplary embodiment). The second transfer roller 84 press-contacts a toner-image-holding-surface side of the intermediate transfer belt 80. The back roller is disposed at an inner-surface-side of the intermediate transfer belt 80 and is an opposing electrode that opposes the second transfer roller 84. For example, the second transfer roller 84 is connected to ground. A bias having a polarity that is the same as the toner charging polarity is applied to the back roller (the support roller 82).

A cleaning device 53 is disposed at an upstream side of the image forming unit 22*a* that is disposed at an uppermost stream side of the intermediate transfer belt 80. A cleaning blade 54 removes residual toner on the intermediate transfer belt 80.

A send-out roller 61 that sends out a recording medium is provided at the cassette 24. Transport rollers 62 that transport the recording medium are disposed right behind the send-out roller 61. Aligning rollers 63 that supply the recording medium to a second transfer portion (transfer section) at a determined timing are disposed at the transfer path 25 that is situated right in front of the second transfer portion. A fixing device 66 is provided at the transport path 25 at a downstream side of the second transfer portion. Discharge rollers 67 are provided at a downstream side of the fixing device 66. The discharge rollers 67 discharge the recording medium to a sheet-discharge section 68 at an upper portion of the body housing 21.

A manual supplying device 71 is provided on a side of the body housing 21. A recording medium on the manual supplying device 71 is transported towards the transport path 25 by send-out rollers 72 and the transport rollers 62. Further, a duplex recording unit 73 is attached to the body housing 21. When a duplex mode for recording images on both sides of the recording medium is selected, the duplex recording unit 73 operates such that the recording medium on whose one side an image has been recorded is reversed by the discharge rollers 67, the recording medium is introduced into the duplex recording unit 73 by guide rollers 74 that are disposed right in front of the entrance of the duplex recording unit 73, the recording medium is transported along a recording medium return transport path 76 in the duplex recording unit 73 by transport rollers 77, and the recording medium is supplied towards a side of realigning rollers 63.

In the image forming apparatus 10, for example, the so-called borderless printing for transferring a part of each toner image on the outer surface of the intermediate transfer belt 80 to a region including the edges of the recording medium by the second transfer roller 84 is performed. The type of printing is not limited to borderless printing. Ordinary printing for transferring the toner images on the outer surface of the intermediate transfer belt 80 to a region not including the edges of the recording medium by the second transfer roller 84 may also be performed.

Structure of Fixing Device

Next, the fixing device 66 that is disposed in the image forming apparatus 10 is described.

Figure 2:
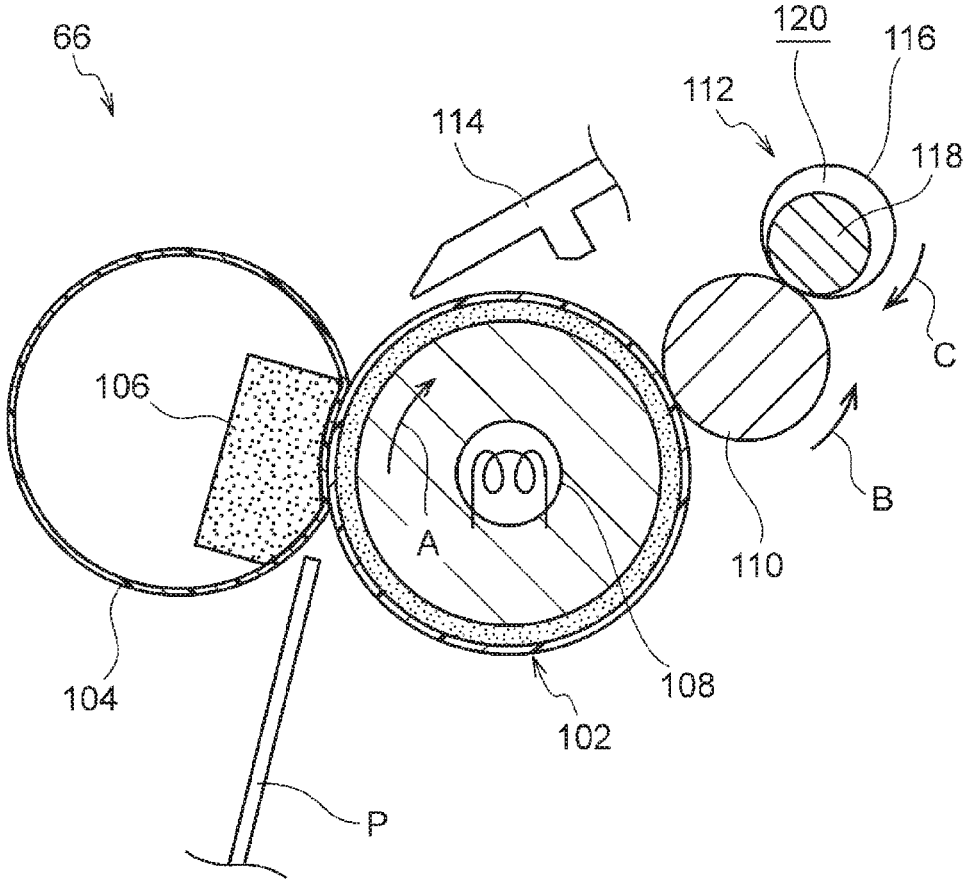
FIG. 2 is a sectional view of a fixing device according to a first exemplary embodiment used in the image forming apparatus shown in FIG. 1.

FIG. 2 is a sectional view of the fixing device 66 according to a first exemplary embodiment. As shown in FIG. 2, the fixing device 66 includes a heating roller 102 and a fixing belt 104. The heating roller 102 serves as an exemplary fixing roller that fixes toner images to a recording medium P. The fixing belt 104 contacts the heating roller 102. A pad 106 that pushes the fixing belt 104 against the heating roller 102 is provided in the fixing belt 104. The heating roller 102 and the fixing belt 104 are disposed side by side in a widthwise direction of the fixing device 66.

The fixing device 66 also includes a cleaning roller 110 that contacts the heating roller 102 and that cleans off any toner adhered to the surface of the heating roller 102. The fixing device 66 further includes a collecting roller 112 that contacts the cleaning roller 110 and that collects any toner adhered to the surface of the cleaning roller 110.

The heating roller 102 has a multilayer structure including a thin-walled cylindrical core made of steel, an elastic layer that covers the surface of the core and is made of, for example, silicone rubber, and a separation layer that covers the surface of the elastic layer and that contains fluororesin. A heat source 108 including a halogen lamp is disposed in the heating roller 102 so as to be situated apart from an inner peripheral surface of the heating roller 102.

The heating roller 102 is rotatably supported by a support member (not shown), and rotates in the direction of arrow A. That is, the heating roller 102 sends the recording medium P in an upward direction at a contact portion (nip) between the heating roller 102 and the fixing belt 104. A guide member 114 that guides the recording medium P that has passed through the contact portion where the heating roller 102 and the fixing belt 104 contact each other is provided above the fixing device 66.

The fixing belt 104 is an endless belt. If necessary, a separation layer containing fluororesin is provided on an outer peripheral surface of a thin-walled cylindrical base made of synthetic resin, such as polyimide resin or polyamide-imide resin. A support section (not shown) that rotatably supports the fixing belt 104 is provided in the fixing belt 104. The fixing belt 104 rotates so as to move in the same direction as the heating roller 102 at a location where the fixing belt 104 contacts the heating roller 102. The fixing belt 104 is formed so as to, along with the heating roller 102, press the recording medium P disposed therebetween. The toner images on the recording medium P are fixed at the contact portion (nip) where an outer peripheral surface of the heating roller 102 and an outer peripheral surface of the fixing belt 104 contact each other.

The cleaning roller 110 has a columnar shape, and is rotatably supported by a support member (not shown). The cleaning roller 110 rotates in the direction of arrow B so as to move in the same direction as the heating roller 102 at a contact portion where the cleaning roller 110 contacts the heating roller 102. In the exemplary embodiment, the cleaning roller 110 is rotated in accordance with the rotation of the heating roller 102. By rotating the cleaning roller 110 that is in contact with the heating roller 102, any toner adhered to the outer peripheral surface (the surface) of the heating roller 102 adheres to an outer peripheral surface of the cleaning roller 110, and the outer peripheral surface of the heating roller 102 is cleaned.

The collecting roller 112 includes a hollow sleeve (tube) 116 that serves as an exemplary substantially cylindrical portion, and a shaft 118 that is disposed in the sleeve 116 and that causes the sleeve 116 to contact the outer peripheral surface of the cleaning roller 110. The shaft 118 has a columnar shape, and is rotatably supported by a support member (not shown). In the exemplary embodiment, an outer peripheral surface of the shaft 118 is arc-shaped (the outer peripheral surface of the shaft 118 does not have grooves).

The sleeve 116 is formed from a substantially cylindrical member. The inside diameter of the sleeve 116 is larger than the outside diameter of the shaft 118. In the exemplary embodiment, the length of the sleeve 116 in an axial direction thereof is greater than the length of the shaft 118 in an axial direction thereof. The length of the shaft 118 in the axial direction thereof is substantially the same as the length of the cleaning roller 110 in an axial direction thereof. In the collecting roller 112, an air passage section 120 through which air passes is formed between an inner peripheral surface of the sleeve 116 and the outer peripheral surface of the shaft 118 at a side opposite to where the sleeve 116 is pushed against the cleaning roller 110 by the shaft 118. The air passage section 120 is disposed along the axial direction of the shaft 118. Both end portions of the air passage section 120 are open. That is, the air passage section 120 extends through the collecting roller 112 along the axial direction of the shaft 118.

The sleeve 116 is supported by the shaft 118 so as to be rotatable in a peripheral direction. In the exemplary embodiment, the sleeve 116 rotates (circulates) in the direction of arrow C in accordance with the rotation of the cleaning roller 110. The shaft 118 rotates in the direction of arrow C in accordance with the rotation of the sleeve 116.

By rotating the sleeve 116 that is in contact with the cleaning roller 110, any toner adhered to the outer peripheral surface of the cleaning roller 110 adheres to an outer peripheral surface of the sleeve 116, so that the toner is collected. By rotating the sleeve 116 and the shaft 118, the air in the air passage section 120 easily flows along the axial direction of the shaft 118.

The difference between the inside diameter of the sleeve 116 and the outside diameter of the shaft 118 is, for example, 1 mm or greater, and, desirably, 2 mm or greater.

The sleeve 116 is made of, for example, resin, metal, or a combination thereof. In the exemplary embodiment, the sleeve 116 is made of metal, such as stainless steel or an aluminum alloy.

Operation and Advantages

Next, the operation and advantages according to the exemplary embodiment are described.

As shown in FIG. 2, the fixing device 66 includes the cleaning roller 110 that contacts the heating roller 102 and rotates in the direction of arrow B. By causing any toner adhered to the outer peripheral surface (surface) of the heating roller 102 to adhere to the cleaning roller 110, the outer peripheral surface of the heating roller 102 is cleaned.

The fixing device 66 includes the collecting roller 112 that contacts the cleaning roller 110. The collecting roller 112 includes the sleeve 116 and the shaft 118 that rotatably supports the sleeve 116 that is in contact with the cleaning roller 110. The sleeve 116 contacts the cleaning roller 110 and rotates in the direction of arrow C, and the shaft 118 also rotates in the direction of arrow C with the sleeve 116 being in contact with the cleaning roller 110. Therefore, any toner adhered to the outer peripheral surface of the cleaning roller 110 adheres to the sleeve 116, so that the toner is collected from the outer peripheral surface of the cleaning roller 110.

The air passage section 120 extending through a portion situated between the sleeve 116 and the shaft 118 in the axial direction is formed at a side opposite to a location where the sleeve 116 is pushed against the cleaning roller 110 by the shaft 118. Therefore, in the interior (inner side) of the sleeve 116, a flow of air that passes through the air passage section 120 is generated. The sleeve 116 is cooled at a side opposite to a contact portion where the sleeve 116 contacts the cleaning roller 110. Therefore, the difference between the surface temperature of the sleeve 116 and the surface temperature of the cleaning roller 110 may be maintained. That is, as the time of operation of the fixing device 66 elapses, a reduction in the temperature gradient between the cleaning roller 110 and the sleeve 116 (the surface temperature difference) may be suppressed.

In the collecting roller 112, the difference between the inside diameter of the sleeve 116 and the outside diameter of the shaft 118 is 1 mm or greater. Therefore, the resistance of a path of air that moves through the air passage section 120 disposed between the sleeve 116 and the shaft 118 is reduced, so that the amount of air that moves through the air passage section 120 is increased. Consequently, the sleeve 116 may be easily cooled by the air that passes through the air passage section 120.

In the exemplary embodiment, the sleeve 116 is made of metal. Accordingly, at the side opposite to where the sleeve 116 is pushed against the cleaning roller 110 by the shaft 118, the temperature of the sleeve 116 may be easily reduced (the sleeve 116 may be easily cooled).

Here, a fixing device according to a comparative example is described. The fixing device according to the comparative example, which is not shown, includes a solid collecting roller that contacts a cleaning roller. In this structure, when the time of operation of the fixing device is increased, the surface temperature of the solid collecting roller rises, and the temperature gradient among a heating roller, the cleaning roller, and the collecting roller is reduced. For example, when the surface temperature of the heating roller is Th, the surface temperature of the cleaning roller is Tc, and the surface temperature of the collecting roller is Tw, and with the fixing device such as when the image forming apparatus starts an image forming operation being in a cooled state, $$Th>Tc>Tw.$$

However, in the fixing device according to the comparative example, when the operation time is increased, the surface temperature of the cleaning roller and the surface temperature of the collecting roller rise, as a result of which the temperature gradient from the heating roller to the collecting roller is reduced. That is, the temperature differences between Th, Tc, and Tw are reduced. When the surface temperature of the collecting roller is increased, the melting state of toner on the collecting roller may change, and a part of the toner on the collecting roller may return to the heating roller via the cleaning roller, as a result of which a recording medium may become dirty.

In contrast, the fixing device 66 includes the collecting roller 112 including the air passage section 120 that extends through a portion disposed between the sleeve 116 and the shaft 118 in the axial direction. In the collecting roller 112, a flow of air that passes through the air passage section 120 is generated, so that the sleeve 116 is cooled. Therefore, a reduction in the temperature gradient between the sleeve 116 and the cleaning roller 110 (that is, the difference between the surface temperature of the sleeve 116 and the surface temperature of the cleaning roller 110) may be suppressed. Consequently, even if the time of operation of the fixing device 66 is increased, the rise in the surface temperature of the sleeve 116 may be suppressed. Therefore, the returning of a part of the toner collected by the sleeve 116 to the heating roller 102 through the cleaning roller 110 may be restricted.

Compared to a structure in which the collecting roller that does not include an air passage section contacts the cleaning roller, the fixing device 66 may suppress dirtying of a recording medium caused by toner returning from the collecting roller 112 to the cleaning roller 110 and from the cleaning roller 110 to the heating roller 102.

Compared to a fixing device in which only a central portion of the collecting roller includes an air passage section, the fixing device 66 may suppress dirtying of a recording medium caused by toner returning from the collecting roller 112 to the cleaning roller 110 and from the cleaning roller 110 to the heating roller 102.

Compared to a structure in which the difference between the inside diameter of the sleeve and the outside diameter of the shaft is less than 1 mm, the sleeve 116 of the collecting roller 112 of the fixing device 66 may be easily cooled.

Compared to a structure in which the sleeve is not made of metal, portions of the sleeve 116 of the collecting roller 112 of the fixing device 66 other than a portion thereof opposing the cleaning roller 110 may be easily cooled.

Further, the image forming apparatus 10 including the fixing device 66 performs the so-called borderless printing for transferring a part of each toner image on the outer surface of the intermediate transfer belt 80 to a region including the edges of the recording medium P by the second transfer roller 84. In the borderless printing, toner on the edges of the recording medium P protrudes from the recording medium P when the toner is fixed, and adheres to the heating roller 102. The toner adhered to the heating roller 102 moves onto the cleaning roller 110, and the toner on the cleaning roller 110 adheres to the sleeve 116 of the collecting roller 112. Therefore, compared to a structure in which the collecting roller that does not include an air passage section contacts the cleaning roller, the image forming apparatus 10 may suppress dirtying of the recording medium caused by the toner returning from the collecting roller 112 to the cleaning roller 110 and from the cleaning roller 110 to the heating roller 102. Therefore, it is possible to obtain high-quality images for a long period of time.

First Modification

Figure 3:
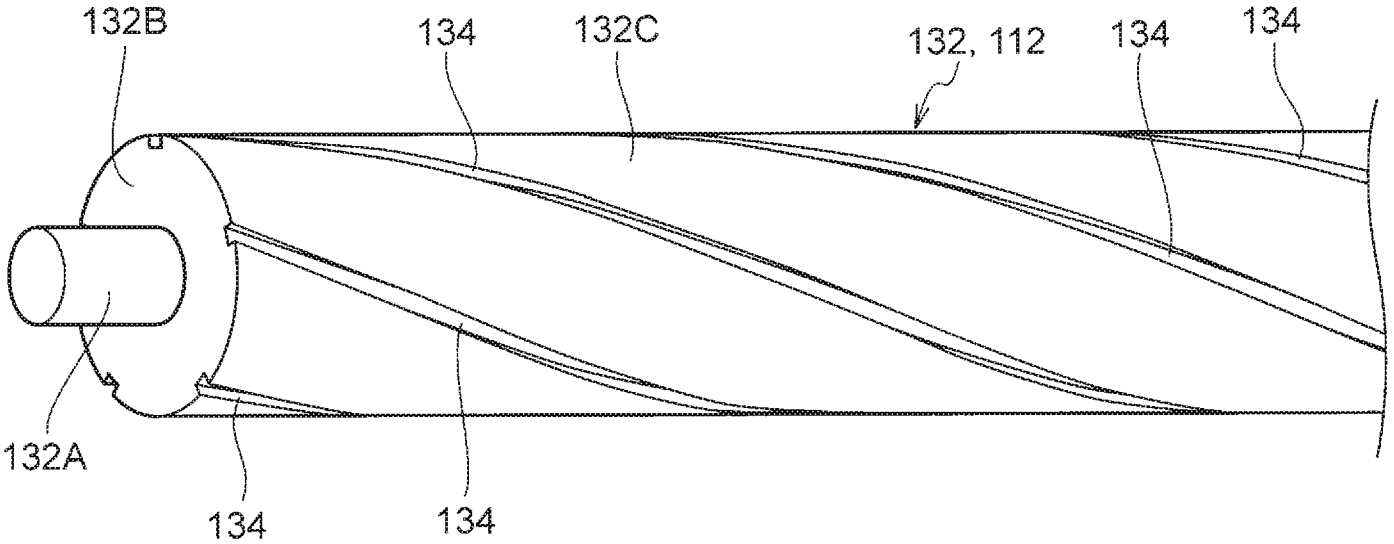
FIG. 3 is a perspective view of a shaft according to a first modification used in a collecting roller shown in FIG. 2.

FIG. 3 is a perspective view of a first modification of a shaft 132 used in the collecting roller 112.

As shown in FIG. 3, in the collecting roller 112 according to the first modification, the shaft 132 is disposed in place of the shaft 118 that is disposed in the sleeve 116 shown in FIG. 2. The shaft 132 includes a rotary shaft 132A that is provided in a central portion of the shaft 132 and an outer peripheral portion 132B that is provided around the rotary shaft 132A. Multiple grooves 134 that are inwardly recessed in a radial direction are provided in a peripheral surface 132C of the outer peripheral surface 132B. The multiple grooves 134 are helically formed apart from each other in the peripheral surface 132C of the collecting roller 112, and continuously provided along the entire length of the peripheral surface 132C in an axial direction thereof. That is, the multiple grooves 134 are provided in a direction that intersects an axial direction of the shaft 132. Although not shown, the shaft 132 is disposed in the sleeve 116 (see FIG. 2), and the sleeve 116 is compressed by the shaft 132 and the cleaning roller 110 (see FIG. 2).

In the collecting roller 112 including the shaft 132, when the shaft 132 is rotated, the following occur at a portion where the sleeve 116 (see FIG. 2) and the shaft 132 contact each other. That is, when the grooves 134 enter this portion, air pressure is increased, whereas, when the grooves 134 leave this portion, air pressure is reduced. Therefore, air in the grooves 134 move in one direction. This causes air in the air passage section 120 (see FIG. 2) in the sleeve 116 to be easily discharged, and, at the same time, causes outside air to be sucked into the air passage section 120 from the outside of the sleeve 116. Therefore, the flow of the air through the air passage section 120 may easily cool the collecting roller 112.

Therefore, compared to a structure in which the peripheral surface of the shaft does not have grooves in a direction that intersects the axial direction, the collecting roller 112 including the shaft 132 may suppress dirtying of a recording medium caused by toner returning from the collecting roller 112 to the cleaning roller 110 and from the cleaning roller 110 to the heating roller 102.

Second Modification

Figure 4:
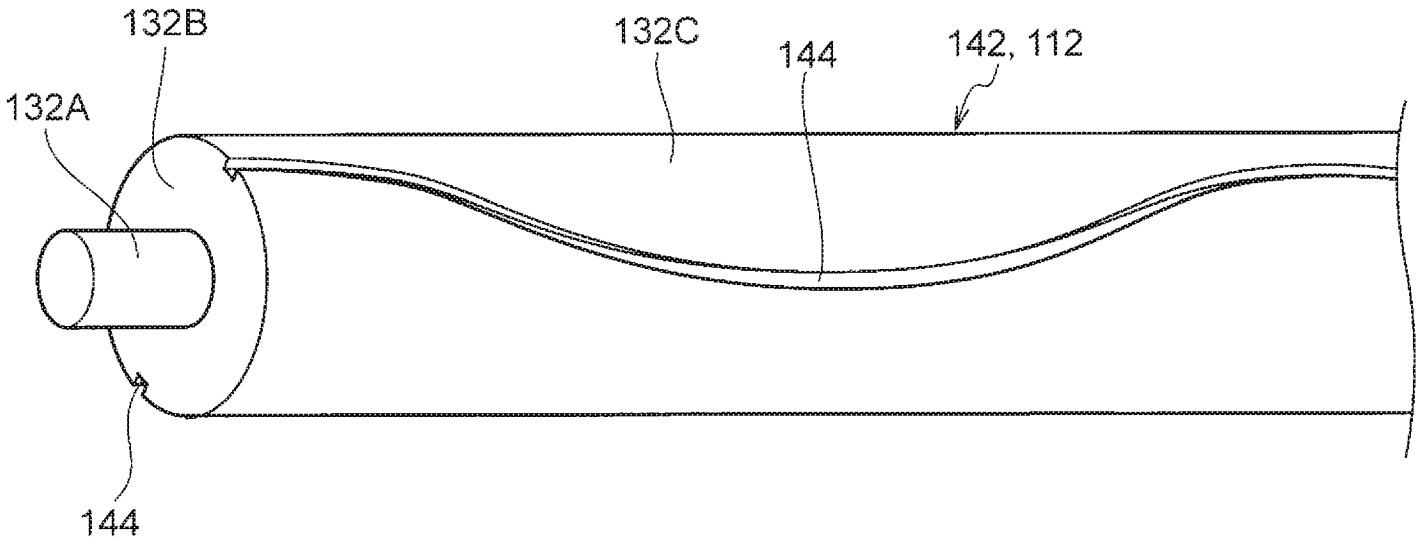
FIG. 4 is a perspective view of a shaft according to a second modification used in the collecting roller shown in FIG. 2.

FIG. 4 is a perspective view of a second modification of a shaft 142 used in the collecting roller 112. Corresponding portions to those of the above-described first modification are given the same reference numerals, and are not described.

As shown in FIG. 4, in the collecting roller 112 according to the second modification, the shaft 142 is disposed in place of the shaft 118 that is disposed in the sleeve 116 shown in FIG. 2. The shaft 142 has multiple grooves 144 that are disposed in a peripheral surface 132C of an outer peripheral portion 132B so as to be curved in side view and so as to extend in a direction that intersects an axial direction thereof. The grooves 144 are continuously provided along the entire length of the shaft 142 in the axial direction thereof. In the modification, two grooves 144 are provided in the peripheral surface 132C of the outer peripheral portion 132B.

In the collecting roller 112 including the shaft 142, when the shaft 142 is rotated, the following occur at a portion where the sleeve 116 (see FIG. 2) and the shaft 142 contact each other. That is, when the grooves 144 enter this portion, air pressure is increased, whereas, when the grooves 144 leave this portion, air pressure is reduced. Therefore, air in the grooves 144 move in one direction. This causes air in the air passage section 120 (see FIG. 2) in the sleeve 116 to be discharged, and, at the same time, causes outside air to be sucked into the air passage section 120 from the outside of the sleeve 116. Therefore, the collecting roller 112 may be easily cooled.

Therefore, compared to a structure in which the peripheral surface of the shaft does not have grooves in a direction that intersects the axial direction, the collecting roller 112 including the shaft 142 may suppress dirtying of a recording medium caused by toner returning from the collecting roller 112 to the cleaning roller 110 and from the cleaning roller 110 to the heating roller 102.

Third Modification

Figure 5:
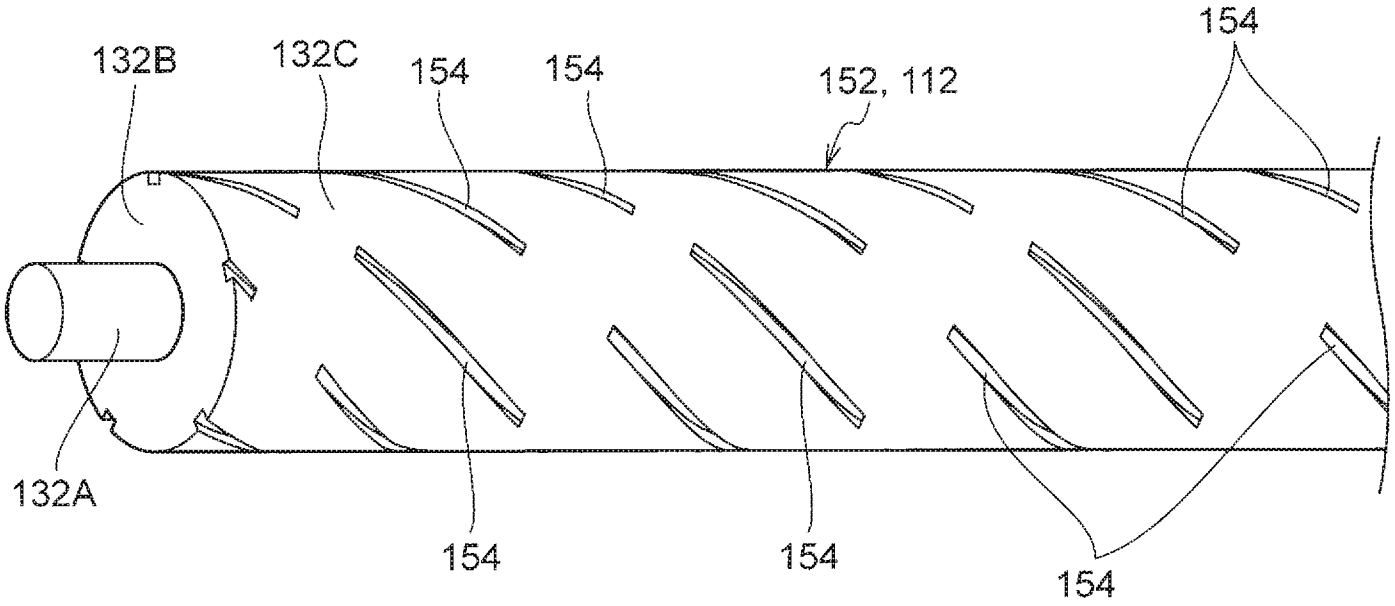
FIG. 5 is a perspective view of a shaft according to a third modification used in the collecting roller shown in FIG. 2.

FIG. 5 is a perspective view of a shaft 152 according to a third modification used in the collecting roller 112. Corresponding portions to those of the above-described first and second modifications are given the same reference numerals, and are not described.

As shown in FIG. 5, in the collecting roller 112 according to the third modification, the shaft 152 is disposed in place of the shaft 118 that is disposed in the sleeve 116 shown in FIG. 2. The shaft 152 has multiple grooves 154 that are disposed in a peripheral surface 132C of an outer peripheral portion 132B as to extend in a direction that intersects an axial direction thereof. The multiple grooves 154 are disposed apart from each other. In the modification, the length of each groove 154 in a longitudinal direction thereof is less than the length of the shaft 152 in the axial direction thereof.

In the collecting roller 112 including the shaft 152, when the shaft 152 is rotated, the following occur at a portion where the sleeve 116 (see FIG. 2) and the shaft 152 contact each other. That is, when the grooves 154 enter this portion, air pressure is increased, whereas, when the grooves 154 leave this portion, air pressure is reduced. Therefore, air in the grooves 154 move in one direction. This causes air in the air passage section 120 (see FIG. 2) in the sleeve 116 to be discharged, and, at the same time, causes outside air to be sucked into the air passage section 120 from the outside of the sleeve 116. Therefore, the collecting roller 112 may be easily cooled.

Therefore, compared to a structure in which the peripheral surface of the shaft does not have grooves in a direction that intersects the axial direction, the collecting roller 112 including the shaft 152 may suppress dirtying of a recording medium caused by toner returning from the collecting roller 112 to the cleaning roller 110 and from the cleaning roller 110 to the heating roller 102.

Second Exemplary Embodiment

Next, a fixing device 160 according to a second exemplary embodiment of the present invention is described with reference to FIGS. 6 and 7. Corresponding structural portions to those according to the above-described first exemplary embodiment are given the same reference numerals, and are not described.

Figure 6:
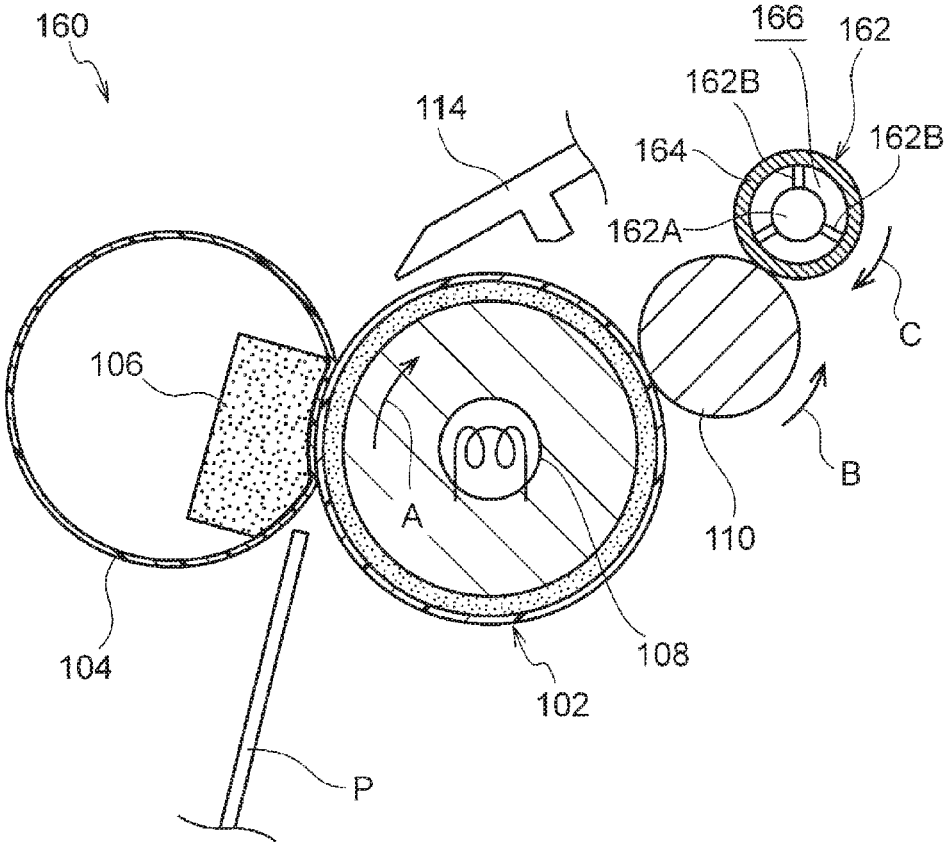
FIG. 6 is a sectional view of a fixing device according to a second exemplary embodiment.

FIG. 6 is a sectional view of the fixing device 160 according to the second exemplary embodiment. FIG. 7 is a perspective view of one end side in an axial direction of a collecting roller 162 used in the fixing device 160. As shown in FIG. 6, in the fixing device 160 according to the second exemplary embodiment, the collecting roller 162 is disposed in place of the collecting roller 112 of the fixing device 66 according to the first exemplary embodiment (see FIG. 2). Since both end portions of the collecting roller 162 in an axial direction thereof are symmetrical in a left-right direction, FIG. 7 illustrates the one end side of the collecting roller 162 in the axial direction, with the other end side of the collecting roller 162 in the axial direction not being shown.

Figure 7:
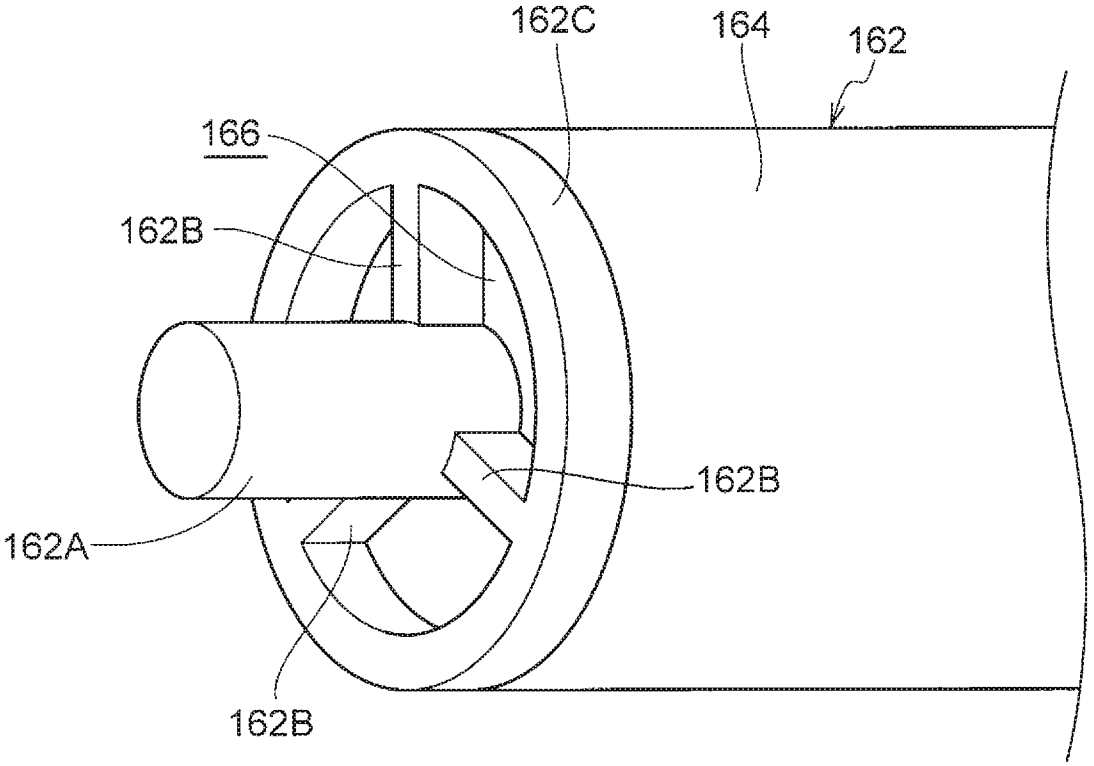
FIG. 7 is a perspective view of a collecting roller used in the fixing device shown in FIG. 6.

Referring to FIG. 7, the collecting roller 162 includes rotary shafts 162A, multiple support sections 162B (in the second exemplary embodiment, three support sections 162B on each rotary shaft 162A), and annular members 162C. Two rotary shafts 162A are provided on two respective end portions of the collecting roller 162 in the axial direction. Each set of three support sections 162B extends radially and outwardly from a peripheral surface of the corresponding rotary shaft 162A. Each annular member 162C is provided on ends of three support sections 162B of the corresponding set. A hollow substantially cylindrical member 164 that is disposed along the axial direction is placed on annular members 162C of the collecting roller 162 at two respective sides in the axial direction (see FIG. 6). A space is provided in an inner side of an inner wall of the hollow substantially cylindrical member 164 so as to extend through the hollow substantially cylindrical member 164 in the axial direction, and is defined as a space passage section 166 (see FIG. 6). In other words, the interior of the hollow substantially cylindrical member 164 is defined as the air passage section 166 that extends through the hollow substantially cylindrical member 164 in the axial direction and through which air passes.

The hollow substantially cylindrical member 164 is made of, for example, resin, metal, or a combination thereof. In the second exemplary embodiment, the hollow substantially cylindrical member 164 (at least, a base) is made of metal, such as stainless steel or an aluminum alloy.

The rotary shafts 162A of the collecting roller 162 are rotatably supported by a support member (not shown). As shown in FIG. 6, the collecting roller 162 contacts a cleaning roller 110. The collecting roller 162 rotates in the direction of arrow C, and moves in the same direction as the cleaning roller 110 at a contact portion where the collecting roller 162 contacts the cleaning roller 110. In the second exemplary embodiment, the collecting roller 162 is rotated in accordance with the rotation of the cleaning roller 110. By this, any toner adhered to an outer peripheral surface (surface) of the cleaning roller 110 adheres to the hollow substantially cylindrical member 164 of the collecting roller 162, so that the toner is collected from the outer peripheral surface of the cleaning roller 110.

The air passage section 166 extending through the interior of the hollow substantially cylindrical member 164 of the collecting roller 162 in the axial direction is formed in the interior of the hollow substantially cylindrical member 164 of the collecting roller 162. A flow of air that passes through the air passage section 166 is generated, and cools the hollow substantially cylindrical member 164. Therefore, the difference between the surface temperature of the hollow substantially cylindrical member 164 and the surface temperature of the cleaning roller 110 may be maintained. That is, as the time of operation of the fixing device 160 elapses, a reduction in the temperature gradient between the cleaning roller 110 and the hollow substantially cylindrical member 164 (the surface temperature difference) may be suppressed.

In the second exemplary embodiment, the hollow substantially cylindrical member 164 is made of metal. The temperature of the hollow substantially cylindrical member 164 may be easily reduced (that is, the hollow substantially cylindrical member 164 may be easily cooled) at a side opposite to a location where the hollow substantially cylindrical member 164 contacts the cleaning roller 110.

Compared to a structure in which the collecting roller that does not include an air passage section contacts the cleaning roller, the fixing device 160 may suppress dirtying of a recording medium caused by toner returning from the collecting roller 162 to the cleaning roller 110 and from the cleaning roller 110 to the heating roller 102.

In addition, compared to a fixing device in which only a central portion of the collecting roller includes an air passage section, the fixing device 160 may suppress dirtying of a recording medium caused by toner returning from the collecting roller 162 to the cleaning roller 110 and from the cleaning roller 110 to the heating roller 102.

Further, compared to a structure in which the hollow substantially cylindrical member is not made of metal, portions of the hollow substantially cylindrical member 164 of the fixing device 66 other than a portion thereof opposing the cleaning roller 110 may be easily cooled.

Third Exemplary Embodiment

Next, a fixing device 160 according to a third exemplary embodiment of the present invention is described with reference to FIG. 8. Corresponding structural portions to those according to the above-described first and second exemplary embodiments are given the same reference numerals, and are not described.

Figure 8:
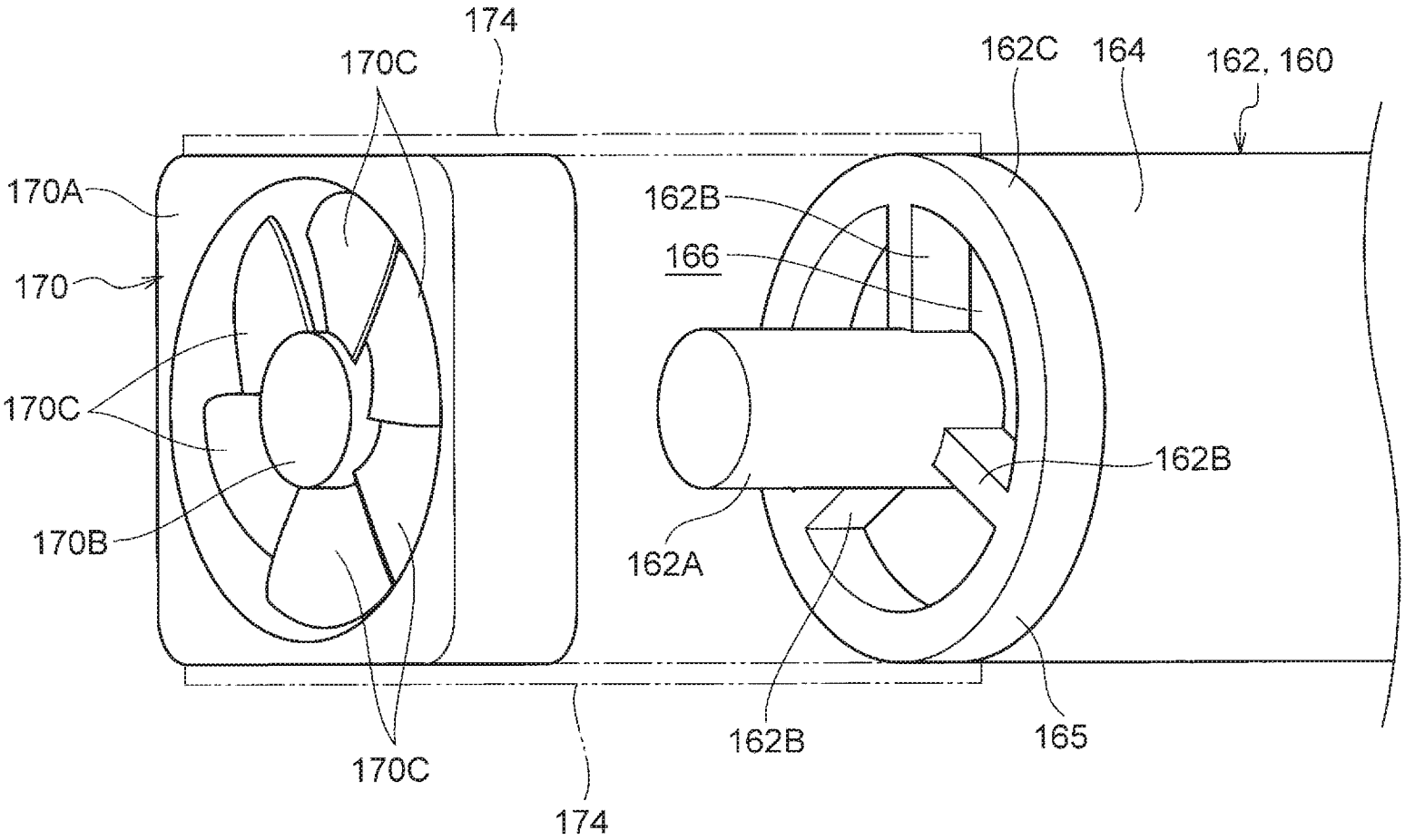
FIG. 8 is a perspective view of a collecting roller used in a fixing device according to a third exemplary embodiment.

FIG. 8 is a perspective view of one end side in an axial direction of a collecting roller 162 used in the fixing device 160 according to the third exemplary embodiment. As shown in FIG. 8, in the fixing device 160 according to the third exemplary embodiment, a fan 170 that is an exemplary blowing member for passing air through an air passage section 166 of the collecting roller 162 is provided at a location opposing one end portion 165 of the collecting roller 162 in an axial direction thereof. The fan 170 includes a support frame 170A, a rotary shaft 170B that is rotatably supported by the support frame 170A, and multiple vanes 170C that are mounted around the rotary shaft 170B. The fan 170 sends wind into the air passage section 166 from the one end portion 165 of the collecting roller 162 in the axial direction thereof as a result of rotation of the rotary shaft 170B by a motor (not shown).

A guide section 174 for guiding the wind generated by the fan 170 to the air passage section 166 is provided between the support frame 170A of the fan 170 and an annular member 162C of the collecting roller 162.

In the fixing device 160 according to the third exemplary embodiment, when the fan 170 rotates, wind is sent to the air passage section 166 from the one end portion 165 of the collecting roller 162 in the axial direction thereof, so that air easily passes through the interior of the air passage section 166, and the collecting roller 162 may be easily cooled. Therefore, compared to a structure in which a fan, which is an exemplary blowing member, is not provided at an end portion of the hollow substantially cylindrical member, the third exemplary embodiment may suppress dirtying of a recording medium caused by toner returning from the collecting roller 162 to a cleaning roller 110 and from the cleaning roller 110 to a heating roller 102.

Fourth Exemplary Embodiment

Next, a fixing device 160 according to a fourth exemplary embodiment of the present invention is described with reference to FIG. 9. Corresponding portions to those of the above-described first to third exemplary embodiments are given the same reference numerals, and are not described.

Figure 9:
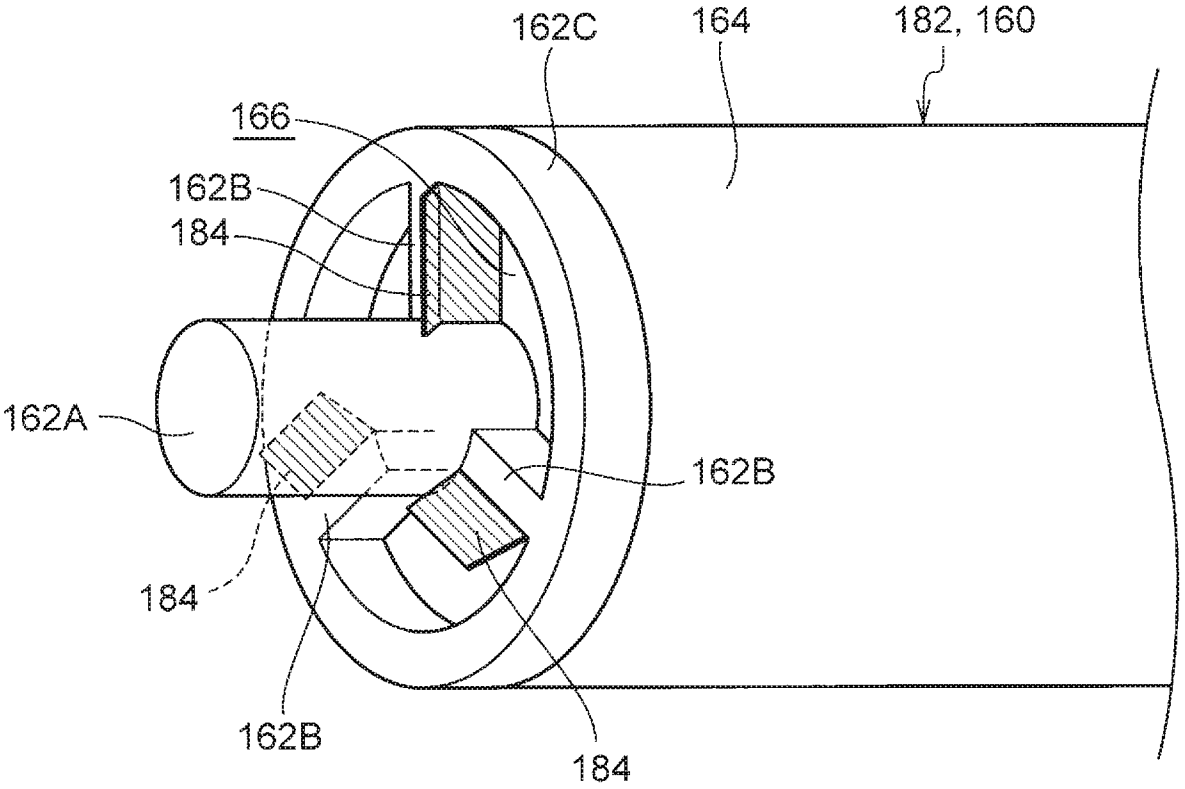
FIG. 9 is a perspective view of a collecting roller used in a fixing device according to a fourth exemplary embodiment.

FIG. 9 is a perspective view of one end side in an axial direction of a collecting roller 182 used in the fixing device 160 according to the fourth exemplary embodiment. As shown in FIG. 9, in the fixing device 160 according to the fourth exemplary embodiment, the collecting roller 182 is provided in place of the collecting roller 162 shown in FIG. 6. Fins 184 that are exemplary blowing members for passing air through an air passage section 166 are each provided at a corresponding one of support sections 162B (in the fourth exemplary embodiment, three support sections 162B) of the collecting roller 182. Each support section 162B extends radially and outwardly from a peripheral surface of the rotary shaft 162A and is provided with the corresponding fin 184 that is disposed in an intersection direction from one wall surface of a corresponding one of the support sections 162B in a peripheral direction of the rotary shaft 162A (that is, on a surface on the same side in a radial direction of the rotary shaft 162A). The fins 184 are disposed along the entire length of the corresponding support section 162B in a radial direction thereof. When the collecting roller 182 is viewed from a side surface thereof, the fins 184 are disposed so as to be inclined in a direction away from the air passage section 166.

In the fixing device 160 according to the fourth exemplary embodiment, when the collecting roller 182 is rotated while the collecting roller 182 contacts a cleaning roller 110 (see FIG. 6), the fins 184 that are provided on the respective support sections 162B (in the fourth exemplary embodiment, three support sections 162B) generate a flow of air. This makes it easier for air to pass through the interior of the air passage section 166 of the collecting roller 182, so that the collecting roller 182 may be easily cooled. Therefore, compared to a structure in which an end portion of the hollow substantially cylindrical member is not provided with fins as exemplary blowing members, the fourth exemplary embodiment may suppress dirtying of a recording medium caused by toner returning from the collecting roller 182 to the cleaning roller 110 and from the cleaning roller 110 to a heating roller 102.

Fifth Exemplary Embodiment

Next, a fixing device 160 according to a fifth exemplary embodiment of the present invention is described with reference to FIGS. 10 and 11. Corresponding portions to those of the above-described first to fourth exemplary embodiments are given the same reference numerals, and are not described.

Figure 10:
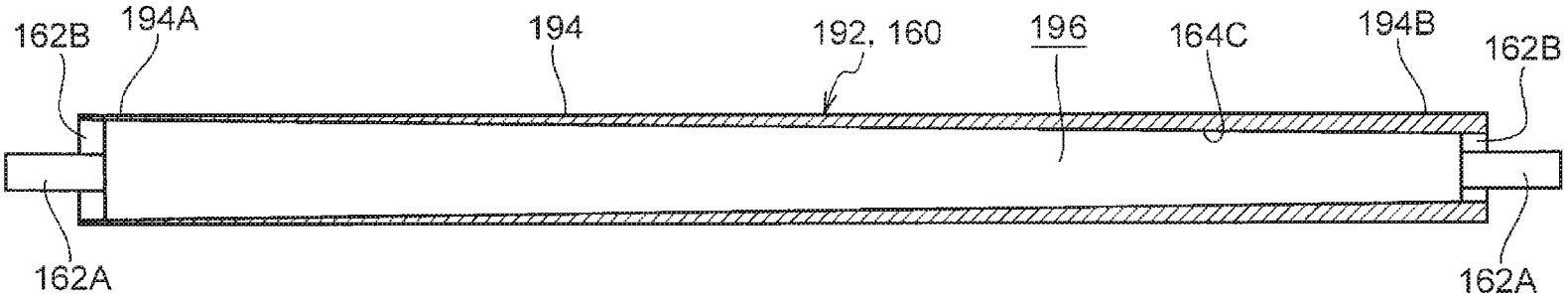
FIG. 10 is a sectional view of a collecting roller used in a fixing device according to a fifth exemplary embodiment.
Figure 11:
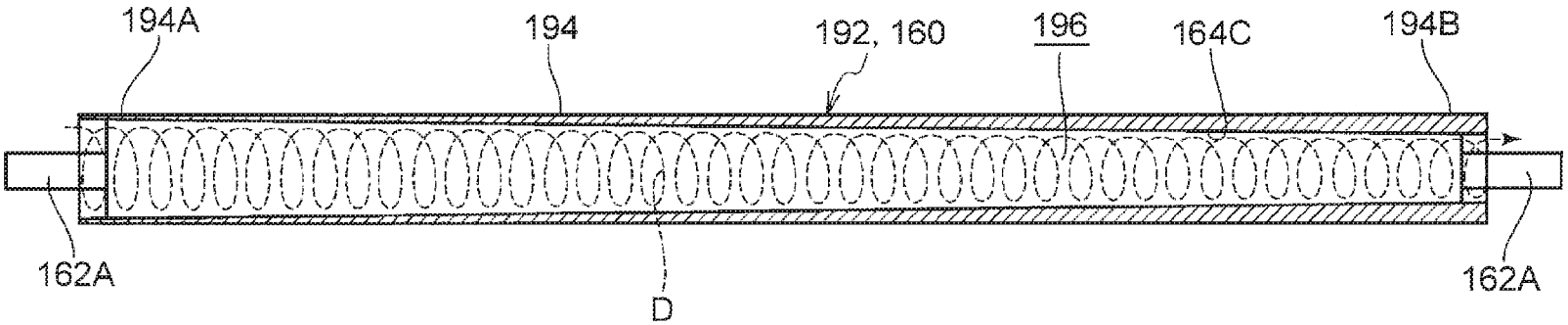
FIG. 11 is a schematic sectional view showing a state in which air passes through the interior of the collecting roller shown in FIG. 10.

FIGS. 10 and 11 are each a sectional view of a collecting roller 192 used in the fixing device 160 according to the fifth exemplary embodiment. As shown in FIG. 10, in the fixing device 160 according to the fifth exemplary embodiment, the collecting roller 192 is provided in place of the collecting roller 162 shown in FIG. 6. The collecting roller 192 includes a hollow substantially cylindrical member 194 along an axial direction thereof. An air passage section 196 is provided in the interior of the hollow substantially cylindrical member 194. The hollow substantially cylindrical member 194 is formed such that the inside diameter of one end portion 194A in the axial direction thereof is greater than the inside diameter of the other end portion 194B in the axial direction thereof, and such that the inside diameter of the hollow substantially cylindrical member 194 from the one end portion 194A in the axial direction towards the other end portion 194B in the axial direction becomes gradually smaller.

In other words, when the hollow substantially cylindrical member 194 is viewed in cross section, an inner wall 194C of the hollow substantially cylindrical member 194 is inclined such that the inside diameter of the hollow substantially cylindrical member 194 from the one end portion 194A in the axial direction towards the other end portion 194B in the axial direction becomes gradually smaller. Therefore, as shown in FIG. 11, when the collecting roller 162 rotates, a pressure difference occurs between the one end portion 194A and the other end portion 194B of the hollow substantially cylindrical member 194, so that air in the air passage section 196 is discharged. More specifically, the air in the air passage section 196 of the hollow substantially cylindrical member 194 while circulating in the direction of arrow D flows from the side of the one end portion 194A where the inside diameter of the hollow substantially cylindrical member 194 is large towards the side of the other end portion 194B where the inside diameter of the hollow substantially cylindrical member 194 is small. Therefore, the air in the air passage section 196 is discharged from the other end portion 194B where the inside diameter of the hollow substantially cylindrical member 194 is small, and outside air is sucked into the air passage section 196 from the one end portion 194A where the inside diameter of the hollow substantially cylindrical member 194 is large. Consequently, the flow of air through the air passage section 196 of the hollow substantially cylindrical member 194 may make it easy for the hollow substantially cylindrical member 194 to cool.

Therefore, compared to a structure in which there is no difference in the inside diameter from the one end portion towards the other end portion of the hollow substantially cylindrical member, the fixing device 160 according to the fifth exemplary embodiment may suppress dirtying of a recording medium caused by toner returning from the collecting roller 192 to a cleaning roller 110 and from the cleaning roller 110 to a heating roller 102.

Although, in the collecting roller 182 according to the fourth exemplary embodiment, each support section 162B is provided with the fin 184, the present invention is not limited to this structure. For example, fins for passing air through the air passage section may be provided on an inner surface (inner wall surface) of the hollow substantially cylindrical member of the collecting roller. Alternatively, for example, fins may be provided on at least a portion of the inner surface (inner wall surface) of the hollow substantially cylindrical member of the collecting roller so as to extend in a direction that intersects the axial direction.

Although, in the collecting roller according to the first exemplary embodiment, the sleeve and the shaft are rotated in accordance with the rotation of the cleaning roller, the present invention is not limited to this structure. For example, the sleeve may be rotated independently of the cleaning roller by rotationally driving the shaft.

Although, in the collecting rollers according to the second to the fifth exemplary embodiments, the collecting roller is rotated in accordance with the rotation of the cleaning roller, the present invention is not limited to this structure. For example, the collecting roller may be rotated independently of the cleaning roller by rotationally driving the collecting roller.

Although the present invention is described in detail with reference to particular exemplary embodiments, the present invention is not limited to such exemplary embodiments. It is obvious to those skilled in the art that various other exemplary embodiments are possible within the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing roller that fixes a toner image to a recording medium;

a cleaning roller that contacts the fixing roller and rotates, and cleans off toner adhered to a surface of the fixing roller; and a collecting roller that contacts the cleaning roller and rotates, and collects toner adhered to a surface of the cleaning roller, the collecting roller including an air passage section that extends through the collecting roller in an axial direction of the collecting roller and through which air passes, wherein the collecting roller includes a hollow substantially cylindrical member, and an interior of the hollow substantially cylindrical member is defined as the air passage section, wherein an inside diameter of the hollow substantially cylindrical member becomes gradually smaller from one end portion of the hollow substantially cylindrical member towards the other end portion of the hollow substantially cylindrical member in the axial direction.

2. The fixing device according to claim 1, wherein the collecting roller includes a substantially cylindrical portion and a shaft that is disposed in the substantially cylindrical portion and that rotatably supports the substantially cylindrical portion that is in contact with the cleaning roller, and wherein the air passage section is disposed between the substantially cylindrical portion and the shaft.

3. The fixing device according to claim 2, wherein a difference between an inside diameter of the substantially cylindrical portion and an outside diameter of the shaft is 1 mm or greater.

4. The fixing device according to claim 2, wherein a peripheral surface of the shaft has a groove in a direction that intersects the axial direction.

5. The fixing device according to claim 2, wherein the substantially cylindrical portion is made of metal.

6. The fixing device according to claim 1, wherein an end portion or an inner surface of the hollow substantially cylindrical member is provided with a blowing member for passing air through the air passage section.

7. The fixing device according to claim 1, wherein the hollow substantially cylindrical member is made of metal.

8. A collecting roller comprising:

a substantially cylindrical portion; and a shaft that is disposed in the substantially cylindrical portion such that an air passage section is disposed between the substantially cylindrical portion and the shaft that are apart from each other, the shaft rotatably supporting the substantially cylindrical portion that is in contact with a cleaning roller that cleans off toner adhered to a fixing roller, a peripheral surface of the shaft having a groove in a direction that intersects an axial direction, wherein the collecting roller is disposed so as to contact the cleaning roller, wherein the substantially cylindrical member hollow portion, and an interior of the hollow portion is defined as the air passage section, wherein an inside diameter of the hollow portion becomes gradually smaller from one end portion of the hollow portion towards the other end portion of the hollow portion in the axial direction.

9. A collecting roller comprising:

a hollow substantially cylindrical member including an air passage section that is disposed in the hollow substantially cylindrical member, wherein an end portion or an inner surface of the hollow substantially cylindrical member is provided with a fin that generates a flow of air in an axial direction as the hollow substantially cylindrical member rotates, and wherein the collecting roller is disposed so as to contact a cleaning roller that cleans off toner adhered to a fixing roller, wherein an interior of the hollow substantially cylindrical member is defined as the air passage section, and wherein an inside diameter of the hollow substantially cylindrical member becomes gradually smaller from one end portion of the hollow substantially cylindrical member towards the other end portion of the hollow substantially cylindrical member in the axial direction.

10. An image forming apparatus comprising:

the fixing device according to claim 1; and a transport section that transports the recording medium having the toner image formed thereon to the fixing device.

* * * * *